United States Patent [19]

Laybourn et al.

[11] 4,150,757

[45] Apr. 24, 1979

[54] PLURAL DOCUMENT STACKING AND SUBSEQUENT SELECTIVE STACK TRANSPORTING APPARATUS

[75] Inventors: Robert J. Laybourn, San Jose; John J. Lynott, Los Gatos, both of Calif.

[73] Assignee: International Business Machines Corporation, Armonk, N.Y.

[21] Appl. No.: 871,569

[22] Filed: Jan. 23, 1978

[51] Int. Cl.[2] ..... B31B 1/98; B65H 29/60; B65H 33/14

[52] U.S. Cl. ..... 414/107; 93/93 DP; 198/367; 198/442; 271/64; 271/187

[58] Field of Search ..... 214/7; 198/367, 442; 271/64, 80, 187, 242; 93/93 DP, 93 C, 93 R

[56] References Cited

U.S. PATENT DOCUMENTS

| | | | |
|---|---|---|---|
| 3,785,256 | 1/1974 | Nikkel | 93/93 DP |
| 3,849,968 | 11/1974 | Tateisi | 53/54 |
| 4,020,972 | 5/1977 | Lundbad | 221/13 |

*Primary Examiner*—Francis S. Husar
*Assistant Examiner*—George F. Abraham
*Attorney, Agent, or Firm*—George E. Roush

[57] ABSTRACT

Increased reliability is afforded with this simplified apparatus for assembling and transporting a loose stack of documents. The documents are stacked on edge upon a pair of pinch rolls, normally stationary. A back plate is provided for supporting the documents in a loose stack, and preferably a foot plate is included for reliability in accepting documents and in forming the stack. Documents from a plurality of asynchronous sources as well as a single source of documents are readily assembled in the desired stack, for example, with the use of a conventional tined stacking or loading mechanism. The apparatus is readily adaptive to operation by computer for determining the particular documents to be stacked and, upon completion of the stacking, for applying a driving force to the rolls for transporting the assembled loose stack of documents between the rolls to the desired destination. Mechanism is disclosed for transporting the stack to a predetermined destination or diverting it to another destination, normally the ultimate using destination. Alternately a gate, synchronized with the diverting mechanism, is arranged at the end of the transport path to prohibit intrusion into the apparatus until the desired delivery is in order.

10 Claims, 1 Drawing Figure

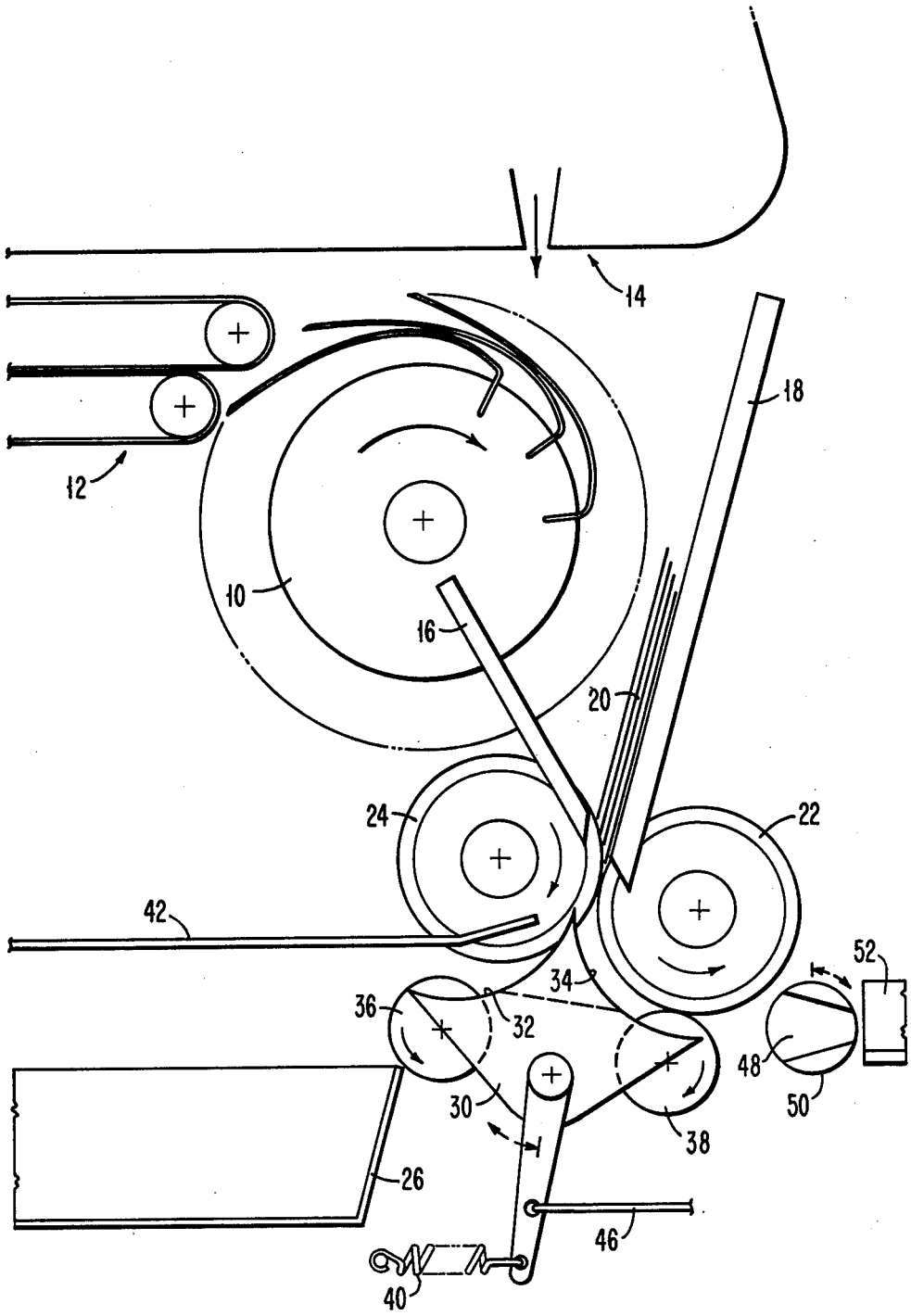
14
18
12
10
16
20
24
22
42
52
34
36
32
48
50
30
38
26
46
40

PLURAL DOCUMENT STACKING AND SUBSEQUENT SELECTIVE STACK TRANSPORTING APPARATUS

The invention is directed to plural document stacking and selective stack transporting apparatus, and it particularly pertains to such apparatus for assembling cash or securities and the like in a stack and thereafter transporting the stack of documents to a destination, preferably in connection with apparatus for insuring the validity of the transaction.

There are prior art mechanisms available for this purpose which are reliable, but not to the degree desired and/or necessary for present day business transactions. Examples of the prior art leading up to the instant invention are found in the following U.S. patents:

| | | | |
|---|---|---|---|
| 1,078,963 | 11/1913 | Sheldon | |
| 1,843,474 | 2/1932 | Wood | |
| 3,061,143 | 10/1962 | Simjian | 221/2 |
| 3,108,680 | 10/1963 | Ellis et al | 193/31 |
| 3,116,668 | 1/1964 | Novick | 93/62 |
| 3,162,439 | 12/1964 | Poland et al | 271/71 |
| 3,182,992 | 5/1965 | Braun | 271/3 |
| 3,531,108 | 9/1970 | Rabinow et al | B65h29/60 |
| 3,684,279 | 8/1972 | Heimlicher | 271/64 |
| 3,767,080 | 10/1973 | Erickson | 221/13 |
| 3,847,384 | 11/1974 | Bethke | 271/80 |
| 3,912,255 | 10/1975 | McInerny | 271/80 |
| 3,974,748 | 8/1976 | Bethke | 93/61A |
| United Kingdom Patent: | | | |
| 1,351,937 | 5/1974 | Whitehead et al | B65h3/00 |
| German Patent: | | | |
| 2,127,815 | 12/1971 | Whitehead et al | B65H3/00 |

which appears to be a counterpart of the UK patent 1,351,937

And in the published literature:

R. J. Laybourn and W. Virgil, "Mechanical Escrow", IBM Technical Disclosure Bulletin, Vol. 18 No. 11, April 1976, pp 3790–3792.

The patents to Sheldon, to Wood and to Rabinow et al. are directed to apparatus for printing and/or sorting documents employing the same type of components for the most part as does the apparatus according to the invention, but the stacking involved is merely the dropping of the documents one upon the other and does not assemble documents in a loose stack and thereafter transport the loose stack.

The patents to Simjian and to Erickson are directed to apparatus for vending a single article and/or to apparatus for feeding a single document at a time from a stack of documents in place within the apparatus. While these structures use components that are similar to those in the apparatus according to the invention, the function and the overall structure of the apparatus are different.

The patent to Ellis is directed to a currency dispensing apparatus which transports Federal Reserve Notes one note at a time by means of a pair of contacting belts. It is notable however that the arrangement does include a diverter for sending the belts either to storage or to issue.

The patents to Novick and to Poland et al. are directed to rotary document handling machines which likewise have components in common with the apparatus of the invention but which stack documents upon a toe plate and against a backing plate and transport the documents by continuously moving belts and/or rolls whereby these apparatus are considerably more complex and of course different in structure from that of the invention.

The patent to Braun is of interest in that it is a complex machine which has incorporated means for preventing or overcoming skew in transport. The functions of the Braun apparatus are met by the instant invention apparatus but by much simpler structure whereby skew is not initiated and therefor need not be considered.

The patent to Heimlicher is directed to document transport apparatus having a tined transfer wheel for transporting documents and a diverter mechanism for diverting some of the documents from one ultimate destination to another. While functionally similar, the apparatus of Heimlicher and that of the invention are structurally different.

The patents to Bethke, which show the same apparatus but feature different portions of that apparatus, and the patent to McInerny are directed to document and like handling apparatus which are continuously running and performing functions different from those of the apparatus according to the invention. While the components are somewhat similar, the functions are different and the overall structure is considerably different.

The United Kingdom and German patents to Whitehead et al are directed to document dispensing apparatus which employee belts and rigid guide means for transporting notes or documents one at a time, but there the similarity ends.

The publication of Laybourn & Virgil, the former of which is a coinventor in the instant application, describes earlier apparatus which is now being replaced with the apparatus according to the invention because the latter is simpler, more reliable and less expensive.

While these prior art references show arrangements of conventional document stacking and document transporting apparatus components, some of which are used in the apparatus according to the invention, they do not show the simple and reliable mechanism that is described hereinafter.

The objects indirectly referred to hereinbefore and those that will appear as the specification progresses are attained by means of extremely simple assembly of conventional components, which have proved reliable in the past, and novel components designed for commensurate reliability. The documents to be assembled are stacked on edge upon a pair of pinch rolls which are normally stationary. A back plate is provided for supporting the documents in a loose stack, and preferably a foot plate is included for reliability in accepting the documents from the sorces and in confining the documents closely to the forming stack. The apparatus is arranged for accepting documents from a plurality of sources in asynchronism as well as from a single source. In most applications the documents will be delivered under computer control and that computer control is extended to include controlling a driving force applied to the roll for transporting the assembled loose stack of documents between the rolls to a predetermined destination.

In transactions involving bank notes or currency or securities and the like, care is taken to insure validity of the transaction before the documents are delivered. Thus the apparatus is set up to transport the documents to a predetermined destination in readiness for possible rejection of the transaction, and a mechanical gating mechanism preferably under computer control is arranged for diverting the transportation of the stack to an ultimate destination, such as a delivery tray from which the stack in manually removed.

Desirably intrusion into the apparatus is prohibited at all times except when the ultimate delivery is to be made. A simple rotating gate is interposed in the transportation path and synchronized with the diverting mechansim so that the gate is open to the delivery tray only when the diverting mechanism is moved to the position for delivery.

In order that the practical aspects of the invention obtain in practice, one embodiment thereof, given by way of example only, is described hereinafter with reference to the drawing, forming a part of the specification, and in which the sole FIGURE is a schematic diagram of a plural document stacking and thereafter selective stack transporting apparatus according to the invention.

Referring to the drawing, there is shown a tined loading wheel 10 which is arranged to accept documents, for example, Federal Reserve Notes, from a plurality of sources, of which two are suggested here as a simple friction belt document transport 12 and a document or currency cartridge 14. Several more such sources of documents are readily accomodated with such a tined loading wheel as those skilled in the art will recognize. The latter is arranged adjacent to a foot plate 16 and a back plate 18 forming a virtual hopper into which documents are dropped to form a loose stack 20 of such documents. The documents in the stack 20 rest on one or both of a pair of rolls 22 and 24. The latter rolls are normally stationary, however, the roll 22 is arranged in conventional fashion to be driven on demand and the roll 24 is a conventional idler roll. It is to be understood that the roll 24 can be the driven roll if desired, but it will be described hereinafter as an idler roll. The plates 16 and 18 and the rolls 22 and 24 are arranged in conventional fashion whereby the rolls have a pinch region within the V formed by the plates 16 and 18 and a throat is provided at the bottom of the plates 16 and 18 so that the stack 20 is transported by the rolls 22 and 24 when driven, for example, on computer demand, between the rolls to a predetermined destination such as a bin 26.

As previously described, a conventional foot plate 16 is provided against which the documents "toe" in conventional manner and fall back on the back plate 18 to form the stack. In many application, however, the loading wheel 10 is arranged particularly so that the documents toe in on the idler roll 24 and the foot plate need not be used, although preferably, it or a similar guard will insure that no document goes elsewhere within the apparatus. It is also preferable that the back plate 18 be arranged to direct the first document into the pinch where it will touch both rolls 22 and 24 and the remainder of the documents touch only the idler roll 24. Such an arrangement insures a substantially uniform "shingling" of the documents in the stack which is considered desirable in dispensing Federal Reserve Notes and the like.

A diverting mechanism 30 is arranged beneath the rolls 22 and 24 for guiding the stack 20 into the bin 26. The diverting mechanism 30 is provided with two guiding surfaces 32 and 34 and two idler rolls 36 and 38. Normally the diverting mechanism 30 is biased by conventional means, shown here as a spring 40, into a position in which the idle roll 36 contacts the idle roll 24 whereby the stack 20 when the power roll 22 is energized will pass between the rolls 22 and 24 along the guiding surface 32 and between the rolls 24 and 26 into the reject bin 26 with a deflector 42 insuring that the stack 20 does not go elsewhere within the apparatus.

With the exception of the diverter 30 and the rolls 36 and 38, the rotating components described have fixed position axle bearings, which feature is of decided advantage both in manufacture and in maintenance of the apparatus. Also it should be noted that the drive motor (not shown) need rotate in one direction only, which feature is also a decided advantage of the apparatus according to the invention.

The internal bin 26 as shown here basically acts, for example, as a "reject" bin for stacks 20 which are not suitable for issue as determined by associated computer apparatus. One primary purpose of the apparatus according to the invention, for example, is to dispense the stack 20. When the computing apparatus determines that the issue is valid, a solenoid (not shown) acts on a solenoid bar 46 to shift the diverter mechanism 30 whereby the idle roll 38 is in contact with the power roll 22 and the stack 20 passes through the throat between the rolls 22 and 24 and then between the guiding surface 34 and the roll 22 and thence through a throat 48 of a antitampering gate 50 into an issuing tray 52.

The rolls 22, 24, 36 and 38 are conventional rolls for most applications but preferably they are fitted with a resilient material, such as rubber, neoprene and the like, which makes for a better grip on the documents and for an "automatic adjustment" for wear on Federal Reserve Notes and such documents, which also makes the apparatus insensitive to differences in the thickness, cleanliness and the like of different types of documents material.

While the invention has been described in terms of a single express embodiment, it should be understood that those skilled in the art will make changes and substitutions without departing from the spirit and scope of the appended claims concluding the specification.

The invention claimed is:

1. Plural document stacking and selective stack transporting apparatus, comprising, a pair of intermittantly driven members arranged for blocking said documents when idle and for passing a stack of said documents therebetween when driven, a back plate arranged with respect to said members for assembling a stack of said documents with one edge resting on at least one of said members mechanism arranged with respect to said back plate for depositing documents onto said one member, and drive mechanism for driving said members and transporting said stack of documents therebetween.

2. Plural document stacking and selective stack transporting apparatus, comprising, a pair of intermittantly driven pinch rolls arranged for passing a stack of said documents therebetween when driven, a back plate arranged with respect to said pinch rolls for assembling a stack of said documents with one edge resting on at least one of said pinch rolls, a foot plate arranged with respect to said back plate over said pinch rolls for confining said documents between said plates over said rolls and leaving a throat between said plates allowing passage of said stack therebetween, mechanism arranged with respect to said plates for depositing documents onto said one roll, and drive mechanism for driving said rolls and transporting said stack of documents therebetween.

3. Plural document stacking and selective stack transporting apparatus, comprising, a pair of intermittantly driven pinch rolls arranged for passing a stack of said documents therebetween when driven, a back plate arranged with respect to said pinch rolls for assembling a stack of said documents with one edge resting on at least one of said pinch rolls, mechanism arranged with respect to said plates for depositing documents onto said one roll, drive mechanism for driving said rolls and transporting said stack of documents therebetween, and gating mechanism arranged with respect to said rolls for diverting said stack being transported from one ultimate destination to another.

4. Plural document stacking and selective stack transporting apparatus as defined in claim 3 and incorporating other gating mechanism arranged in the path of said stack being transported to said other destination for opening said path only when the first said gating mechanism is diverting the passage of said stack of documents.

5. Plural document stacking and selective stack transporting apparatus, as defined in claim 3, and incorporating a foot plate arranged with respect to said back plate over said pinch rolls for confining said documents between said plates over said rolls and leaving a throat between said plates allowing passage of said stack therethrough.

6. Plural document stacking and selective stack transporting apparatus, as defined in claim 5 and wherein said mechanism arranged with respect to said back plate for depositing documents onto said one roll comprises a tined loading wheel.

7. Plural document stacking and selective stack transporting apparatus, as defined in claim 5 and wherein said diverting mechanism is provided with surfaces concentric with said rolls for guiding said stack of documents.

8. Plural document stacking and selective stack transporting apparatus as defined in claim 7 and wherein said diverting mechanism is also provided with rolls cooperating with the first said rolls.

9. Plural document stacking and selective stack transporting apparatus as defined in claim 5 and wherein said other gating mechanism comprises a cylindrical member having a throat therethrough along the longitudinal axis thereof arranged in the path of said stack being transported to said other destination.

10. Plural document stacking and selective stack transporting apparatus, as defined in claim 5 and wherein said diverting mechanism is spring biased for transporting said stack normally to said one ultimate destination.

* * * * *